US006339861B1

(12) United States Patent
Snyder

(10) Patent No.: US 6,339,861 B1
(45) Date of Patent: Jan. 22, 2002

(54) VACUUM CLEANER POWER CORD SYSTEM

(76) Inventor: Vicki L. Snyder, 282 Road #29, Kimball, NE (US) 69145

( * ) Notice: Subject to any disclaimer, the term of this patent is extended or adjusted under 35 U.S.C. 154(b) by 0 days.

(21) Appl. No.: 09/767,812

(22) Filed: Jan. 24, 2001

(51) Int. Cl.[7] ..... A47L 9/26
(52) U.S. Cl. ..... 15/323; 15/410; 191/12 R
(58) Field of Search ..... 15/323; 191/12 R

(56) References Cited

U.S. PATENT DOCUMENTS

| | | | | | |
|---|---|---|---|---|---|
| 1,953,581 | A | * | 4/1934 | Ballou | 191/12 R |
| 2,527,486 | A | | 10/1950 | Osborn | |
| 2,591,250 | A | * | 4/1952 | Gerber | 15/323 |
| 2,607,863 | A | * | 8/1952 | MacFarland | 15/323 X |
| 3,813,054 | A | | 5/1974 | Klingspor | |
| 3,813,501 | A | | 5/1974 | Melettie et al. | |
| 4,667,460 | A | * | 5/1987 | Kramer | 191/12 R X |
| 5,318,158 | A | | 6/1994 | Seasholtz | |
| 5,498,940 | A | | 3/1996 | Kim et al. | |
| 5,540,312 | A | * | 7/1996 | Ogawa et al. | 191/12 R |
| 5,720,627 | A | * | 2/1998 | Gillbrand et al. | 191/12 R X |
| 5,841,259 | A | | 11/1998 | Kim et al. | |
| 5,937,476 | A | | 8/1999 | Kim | |

* cited by examiner

*Primary Examiner*—Chris K. Moore
(74) *Attorney, Agent, or Firm*—William B. Noll

(57) ABSTRACT

A manually retractable electric power cord system for a mobile appliance, such as an upright vacuum cleaner. The power cord, in combination with the mobile appliance, comprises a coiled power cord that has a memory to restore its coiled shape when in the relaxed or resiled state, and an elongated rod extending generally vertically from the mobile appliance. Hand gripping members are provided along the power cord to help the operator to manually pickup and feed the coiled power cord onto the elongated rod.

8 Claims, 2 Drawing Sheets

44
10
14
42
38
40
16
20
18

VACUUM CLEANER POWER CORD SYSTEM

FIELD OF THE INVENTION

This invention is directed to the field of upright vacuum cleaners, more particularly to a coiled power cord therefor having a memory, and a cleaner mounted bar for receiving the coiled power cord during periods of nonuse.

BACKGROUND OF THE INVENTION

The present invention relates to an improved power cord system for vacuum cleaners, especially of the upright variety, where the cord, in a relaxed or resiled condition is coiled for easy placement on a vacuum cleaner mounted rod during periods when the cord is to be stored, or extended beyond the needed length for operating.

Very often in performing the relatively simple task of vacuuming, the extended power cord can become a problem to the operator of the vacuum. Typically, there are no convenient means to retract the cord during use so the inconvenience of the extended cord remains an obstacle to vacuuming. However, there are a number of cord retraction systems in the prior art whereby, after completion of the vacuuming operation, the cord may be readily retracted into the vacuum housing or canister. Exemplary systems of cord controlling mechanisms may be found in the following U.S. Patents:

a.) U.S. Pat. No. 5,937,476, to Kim, is directed to a vacuum cleaner with a cord-reel release apparatus having a handle in place of a cord reel button. The cord-reel release apparatus has a cord reel, a brake member, an elastic member, and a handle. The cord reel winds a power cord. The brake member is in contact with circumference of the cord reel and selectively limits rotation of the cord reel. The elastic member causes one part of the brake member to contact with the cord reel. The handle presses the other part of the brake member. The handle further has a hooking prominence formed on a side part thereof, thereby the hooking prominence is hooked to a hooking depression formed in an accommodation groove of a body. With the constitution, when the brake member is pressed by the handle, the brake member departs from the cord reel. Then, the power cord drawn out is wound up at the cord reel by elastic force of a spiral spring in the cord reel.

b.) U.S. Pat. No. 5,498,940, to Kim et al., teaches a system to maintain constant tension on the cord of a robot by determining whether the cord is being extracted or retracted and the extent of such extraction or retraction, and increasing or decreasing a spring force applied to the cord by an amount suitable for maintaining a constant tension on the cord.

c.) U.S. Pat. No. 5,318,158, to Seasholtz, relates to a retainer for a portion of an electric power cord having a guide that guides the cord into a space between a pair of ears that cooperate with a grooved part of a handle to define two V notch passageways for the cord leading the cord into a groove which wraps around the handle. The floor of the guide defines with the groove a path for the cord past the ears which is substantially in a plane.

d.) U.S. Pat. No. 3,813,501, to Meletti et al., is directed to a retractable electrical cord-reel apparatus having a pair of hub-and-flange members secured together in sheave-like configuration to accommodate an electrical cord wrapped therearound. The ends of a pair of electrical conductors in the cord terminate within the hub after passage through a gap therein and are secured against lengthwise withdrawal by frictional engagement in serpentine configuration about a plurality of bosses upstanding on the back of one of the hub-and-flange members whose opposite face carries ring-like electrical conductors communicating with the ends of the cord conductors via intervening openings through the member.

e.) U.S. Pat. No. 3,813,054, to Klingspor, teaches a mobile electrical appliance having cord-winding structure therein for an electrical cord which is accessible exteriorly of the appliance and passes through the axis of an apertured supporting wheel rotatably mounted on the appliance at an opening in its side wall.

While the foregoing patents offer a number of solutions for retracting and extending the power cord of a vacuum cleaner, for example, none teach a simple system for keeping a power cord free of interfering with the cleaning operation, where driving over the cord can cause damage to the cord. The manner by which the objective is achieved by this invention will become more apparent in the description which follows.

SUMMARY OF THE INVENTION

This invention is directed to an improved, manually retractable electric power cord for a mobile appliance, such as an upright vacuum cleaner. The power cord, configured in coil form in a relaxed or resiled state, which after extension will return to its coiled state, has what may called a memory. In any case, the power core includes a plurality of U-shaped hand gripping members spaced along the cord to be used in manually lifting and feeding the coiled power cord as later described. For mounting the power cord, the mobile appliance or vacuum cleaner, as the case may be, includes an elongated rod extending from the base thereof generally vertical to and spaced from the housing extending from the base. In a preferred embodiment, the rod has a greater lower cross section to ensure stability to the rod, and is secured to the housing by a flexible bracket. Further, the upper end of the rod is flared upward and outward to present a convenient target for loading the coiled and retracted power cord onto the rod. In another embodiment, the rod may be secured to the upper part of the housing which is more convenient to receive and feed the power cord for the intended task.

Accordingly, an object of this invention is to provide a simple and effective system for manually retracting an extended power cord for a vacuum cleaner, for example.

Another object hereof is the provision of a coiled power cord for a mobile appliance, where the power cord has memory characteristics to allow it to return to a coiled state in a relaxed or non-extended state.

A further object of the invention lies in the use of a rod flexibly for receiving the coiled power cord and mounted to the appliance housing to minimize damage to inadvertant contact with the rod.

These and other objects of the invention will become more apparent in the description which follows, particularly when read by those skilled in the art.

BRIEF DESCRIPTION OF DRAWINGS

FIG. 3 is a reduced side view similar to FIG. 2, showing the vacuum cleaner in a less extended operating state, where the power cord is positioned for manually feeding onto the vertical elongated rod.

DETAILED DESCRIPTION OF PREFERRED EMBODIMENTS

Figure 2:
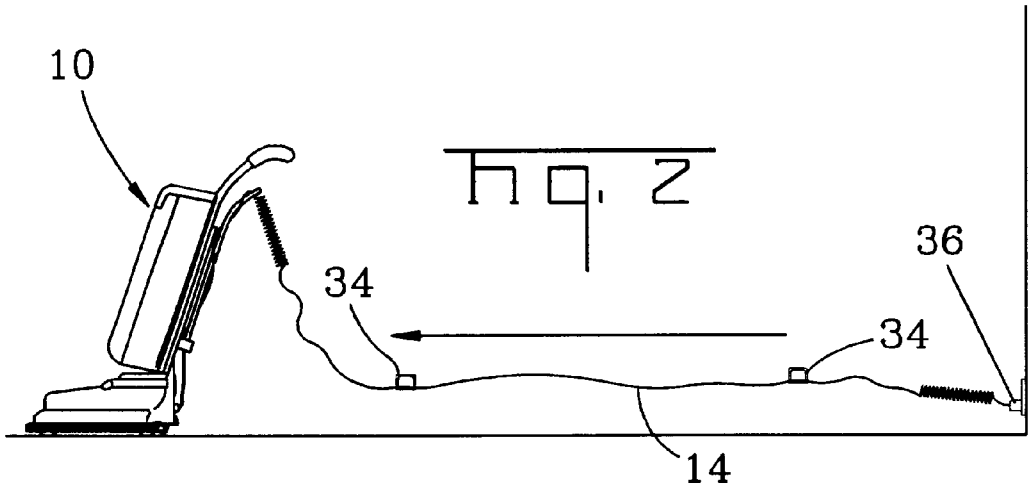
FIG. 2 is a reduced side view of the vacuum cleaner of FIG. 1 showing the power cord in an extended and operating state.
Figure 7:
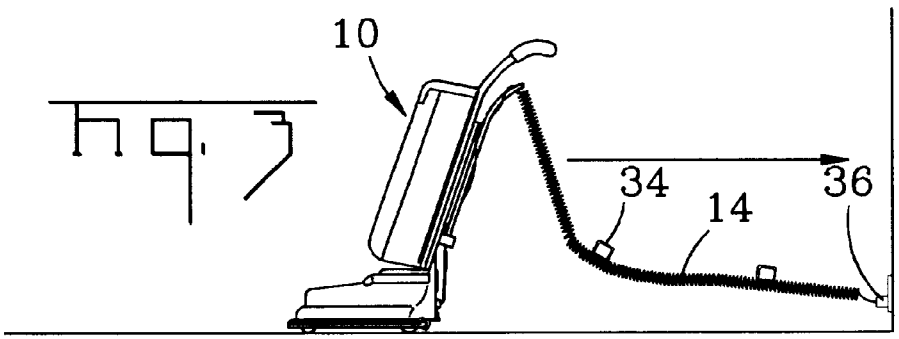

The present invention relates to a manually assisted, electric power cord system for a mobile appliance, more particularly an upright vacuum cleaner, that is readily retracted to avoid being damaged by driving over an outstretched cord on the carpet. The improved electric power cord system of this invention will now be described with regard to the several Figures, where like reference numerals represent like components or features throughout the several views.

Figure 1:
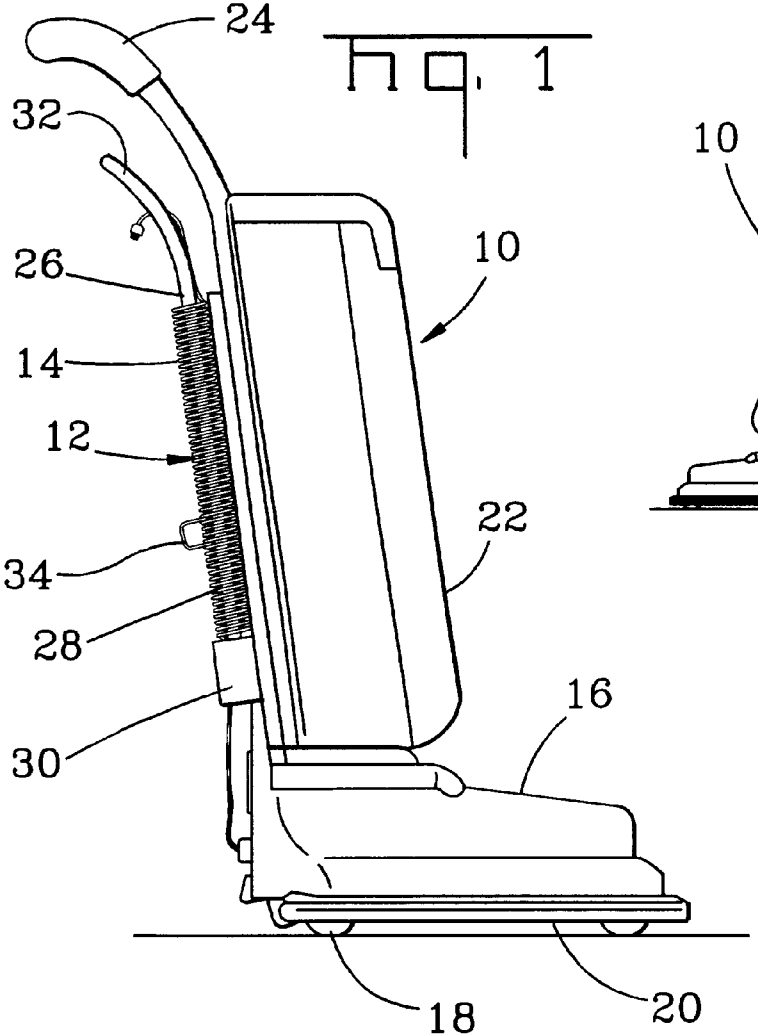
FIG. 1 is a side view of a mobile appliance, more particularly an upright vacuum cleaner, mounting the improved, manually retractable power cord storage system of this invention.

Turning first to FIG. 1, where a mobile appliance, in the preferred form of a vacuum cleaner 10, is illustrated and shows the coiled, manually retractable power cord system 12 of this invention. The system 12 comprises a coiled power cord 14 which is characterized by an ability to resile into a coiled shape when relaxed for ultimate storage as later described. This ability, common with metals and plastics, is like having a "memory", such that the material will return to its normal state in the relaxed or original position. In the case of the coiled power cord 14 the original state is a coiled form. Typically, as known in the art, the material may be heated and wrapped around a mandrel and cooled, which in the case of the power cord hereof may be a mandrel of about 2" to 3" in diameter.

Before understanding fully the improved system 12, further reference is directed to the vacuum cleaner 10. The vacuum cleaner 12 comprises a base 16, having an electric motor (not shown), and plural wheels or casters 18 on its bottom 20 to facilitate rolling the vacuum cleaner along the carpet. Extending vertically above the base 16 is the cleaner housing 22, typically containing the replaceable cleaner bags, mounting a handle 24 for moving and directing the vacuum cleaner where needed.

Returning to the improved system 12 hereof, said system 12 further comprises an elongated rod 26, having a larger cross section 28 along its lower half for stability and added strength, mounted by means of a bracket 30 secured to the cleaner housing 22 in close proximity to the base 16. Preferably, the bracket 30 is semi-flexible, such as made of rubber, or having a coiled spring that permits limited flexing. In any case, this flexibility ensures that inadvertent bumping will neither damage the system nor mar furniture. Further, the upper portion of the rod 26 is provided with an upwardly and outwardly flared end 32 that helps in the power cord feeding process, where the flared end 32 preferably is aligned within the plane of the rod 26.

To facilitate the manual loading or feeding of the coiled power cord 14 onto the flared end of the elongated rod 26, plural U-shaped hand gripping members 34, preferably about two or three, are spaced at intervals along the power cord 14. By this arrangement, the operator can easily and quickly lift the power cord onto the waiting elongated rod 26. Such system eliminates the conventional pair of pivotal arms about which the power cord is typically wound. Sometimes, when time is critical, the power cord is often just draped over the vacuum cleaner. The present invention avoids the conventional cord winding system and ensures an orderly storage of the vacuum cleaner so equipped with the manual cord retractable system of this invention.

FIG. 2 illustrates how the power cord 14 hereof may extend to places well beyond the electric outlet 36, as often required during vacuuming of a carpet. FIG. 3 shows the power cord 14 shape, i.e. coiled, when the vacuum cleaner 12 is close to the outlet 36. Further, the hand gripping members 34 are handy to the operator who merely lifts the power cord 14 and slides or feeds the power cord 14 onto the elongated rod, see FIG. 1.

Figure 4:
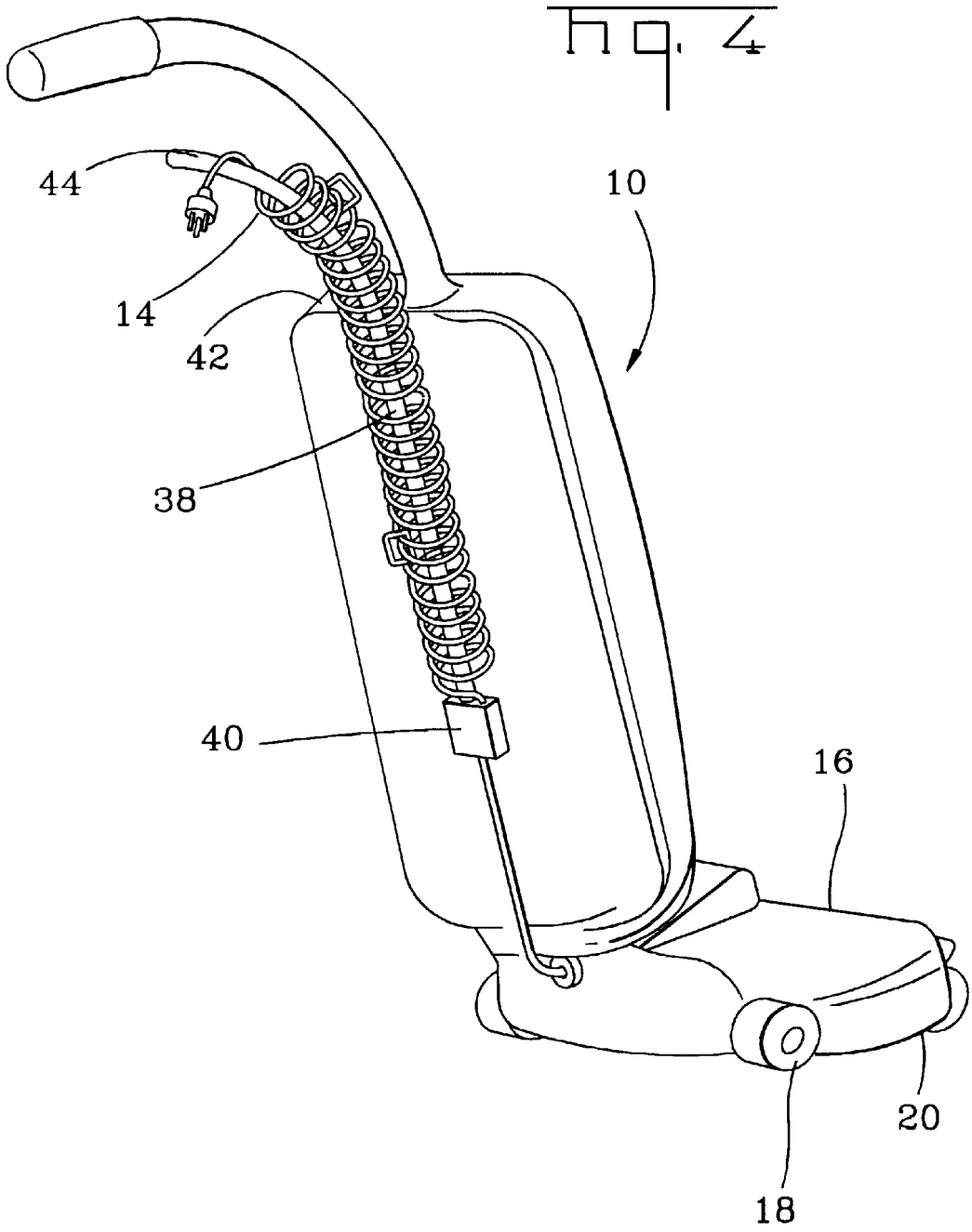
FIG. 4 is a perspective view of a vacuum cleaner illustrating an alternative embodiment with the coil receiving rod mounted to the vacuum cleaner near the top of the vacuum cleaner housing.

FIG. 4 illustrates another embodiment for the system of this invention. In this embodiment, the elongated rod 38 is secured to the cleaner housing 22, by bracket 40, near the top 42 thereof However, in this embodiment the flared portion 44 is longer to accommodate the coiled power cord 14.

It is recognized that modifications, changes and variations may be made to the coiled power cord system of this invention, especially by those skilled in the art, without departing from the spirit and scope thereof. Accordingly, no limitation is intended to be imposed thereon except as set forth in the accompanying claims.

What is claimed is:

1. In combination with a mobile appliance having an electrical and extendible power cord, a coiled power cord for removably mounting on said appliance, said power cord having shape memory capabilities which allow said power cord to return to its coiled shape from an extended to a retracted state, and a plurality of U-shaped hand gripping members spaced along the length of said power cord; and a vertically oriented, elongated rod secured to said appliance, where said rod has an upper end flared away from said appliance, and said rod is of a length for receiving said coiled cord in a fully retracted state.

2. The combination according to claim 1, wherein said appliance is an upright type vacuum cleaner having a base with a vertical housing extending upward therefrom, and said elongated rod is secured to said vacuum cleaner in proximity to said base.

3. The combination according to claim 2, wherein said elongated rod is secured to said vacuum cleaner by means of a semi-flexible bracket.

4. The combination according to claim 2, wherein said elongated rod has a greater cross section along its lower portion.

5. The combination according to claim 2, wherein said base mounts a bracket, and said elongated rod extends vertically therefrom in spaced relation to said vertical housing.

6. The combination according to claim 5, wherein said flared end lies within a plane common to said elongated rod, and is angled away from said vertical housing.

7. The combination according to claim 2, further including a handle to facilitate movement of said vacuum cleaner, and said elongated rod is secured to said vertical housing in close proximity to said handle.

8. The combination according to claim 7, wherein said power cord extends along said vertical housing into said base.

* * * * *